US009065219B2

(12) United States Patent
Naito et al.

(10) Patent No.: US 9,065,219 B2
(45) Date of Patent: Jun. 23, 2015

(54) CONNECTOR HAVING A DETECTION SWITCH INCLUDING A SPRING PORTION AND DETECTION TERMINAL FOR DETECTING INSERTION OF A MATING CONNECTOR

(71) Applicant: JAPAN AVIATION ELECTRONICS INDUSTRY, LIMITED, Shibuya-ku, Tokyo (JP)

(72) Inventors: Takeharu Naito, Tokyo (JP); Masayoshi Nitta, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 134 days.

(21) Appl. No.: 13/919,997

(22) Filed: Jun. 17, 2013

(65) Prior Publication Data

US 2014/0187091 A1 Jul. 3, 2014

(30) Foreign Application Priority Data

Dec. 27, 2012 (JP) ..... 2012-284563

(51) Int. Cl.
*H01R 29/00* (2006.01)
*H01R 13/703* (2006.01)

(52) U.S. Cl.
CPC ..... *H01R 13/7033* (2013.01)

(58) Field of Classification Search
CPC ..... H01R 2103/00; H01R 13/7032; H01R 24/46; H01R 13/703; H01R 13/7033; H01R 13/641; H01R 13/6272; H01R 13/639; H04Q 1/149
USPC ..... 439/188, 489, 607.4, 626
See application file for complete search history.

(56) References Cited

U.S. PATENT DOCUMENTS 3,781,857 A * 12/1973 Stendig et al. ..... 340/521
5,464,353 A * 11/1995 Saijo et al. ..... 439/489
6,638,087 B1 * 10/2003 Takada et al. ..... 439/188

(Continued)

FOREIGN PATENT DOCUMENTS

JP 2003-249290 A 9/2003
JP 2008-262776 A 10/2008

(Continued)

OTHER PUBLICATIONS

Korean Office Action dated May 27, 2014 in counterpart Korean Application No. 10-2013-0068079.

*Primary Examiner* — Abdullah Riyami
*Assistant Examiner* — Vladimir Imas
(74) *Attorney, Agent, or Firm* — Holtz, Holtz, Goodman & Chick PC

(57) ABSTRACT

A connector has a shell and a detection terminal. The shell is formed with a spring portion, which has a front end of a fixed end and extends rearwards. The spring portion includes a pressed portion and a contact portion. The pressed portion is pressed by a mating connector upon insertion of the mating connector into the connector along a front-rear direction. The contact portion is movable in a predetermined direction perpendicular to the front-rear direction. The shell and the detection terminal distinct and separated from the shell form a detection switch. A state of the detection switch is changed due to the movement of the contact portion in the predetermined direction when the pressed portion is pressed by the mating connector, so that the insertion of the mating connector is detected.

11 Claims, 10 Drawing Sheets

(56) References Cited

U.S. PATENT DOCUMENTS

| | | | | |
|---|---|---|---|---|
| 7,207,819 | B2 * | 4/2007 | Chen | 439/188 |
| 7,413,467 | B1 * | 8/2008 | Lai et al. | 439/489 |
| 7,416,428 | B1 * | 8/2008 | Hung et al. | 439/188 |
| 7,909,650 | B2 * | 3/2011 | Matsunaga | 439/630 |
| 8,079,879 | B2 * | 12/2011 | Chiang | 439/660 |
| 8,206,174 | B2 * | 6/2012 | Ko | 439/489 |
| 8,398,416 | B2 * | 3/2013 | Tseng | 439/188 |
| 8,465,308 | B2 * | 6/2013 | Gao et al. | 439/188 |
| 8,535,087 | B1 * | 9/2013 | McKee et al. | 439/489 |
| 8,690,608 | B2 * | 4/2014 | Naito et al. | 439/660 |
| 8,747,147 | B2 * | 6/2014 | Yu et al. | 439/489 |
| 8,905,779 | B2 * | 12/2014 | Little et al. | 439/489 |
| 2009/0061671 | A1 * | 3/2009 | Qin et al. | 439/188 |
| 2011/0281449 | A1 * | 11/2011 | Ko | 439/188 |
| 2012/0052709 | A1 * | 3/2012 | Ko | 439/345 |
| 2012/0322282 | A1 * | 12/2012 | Naito et al. | 439/137 |
| 2013/0316592 | A1 * | 11/2013 | Yu et al. | 439/660 |

FOREIGN PATENT DOCUMENTS

| | | | |
|---|---|---|---|
| JP | 3172188 | U | 12/2011 |
| JP | 2012-099294 | A | 5/2012 |
| JP | 2012-138383 | A | 7/2012 |
| JP | 2012-230877 | A | 11/2012 |
| KR | 1020090042375 | A | 4/2009 |
| KR | 101076652 | A | 10/2011 |

* cited by examiner

CONNECTOR HAVING A DETECTION SWITCH INCLUDING A SPRING PORTION AND DETECTION TERMINAL FOR DETECTING INSERTION OF A MATING CONNECTOR

CROSS REFERENCE TO RELATED APPLICATIONS

An applicant claims priority under 35 U.S.C. §119 of Japanese Patent Application No. JP2012-284563 filed Dec. 27, 2012.

BACKGROUND OF THE INVENTION

This invention relates to a connector which has a function to detect mating of the connector with a mating connector.

As shown in FIG. 19, a connector of JPU 3172188 comprises a shell made of metal and a detection terminal distinct and separated from the shell. The shell is formed with a spring portion, which is connected to a mating shell (not shown) of a mating connector (not shown) when the mating connector (not shown) is inserted into the connector. The detection terminal is fixed at a rear side of the connector and extends forwards therefrom. When the mating connector (not shown) is inserted into the connector, the mating shell (not shown) is connected to the detection terminal and is also connected to the spring portion of the shell. Thus, when the shell and the detection terminal are electrically connected with each other through the mating shell, the insertion of the mating connector is detected.

However, the connector of JPU 3172188 has a low reliability on detection of the insertion of the mating connector.

It is therefore an object of the present invention to provide a connector which has a high reliability on detection of insertion of a mating connector.

SUMMARY OF THE INVENTION

One aspect of the present invention provides a connector which comprises a mating end, a plurality of contacts, a holder, a shell and a detection terminal. The mating end is positioned at a front of the connector in a front-rear direction. The connector mates with a mating connector when the mating connector is inserted through the mating end rearwards. The holder holds the contacts. The shell forms a reception portion which receives, at least in part, the mating connector under a mating state where the connector mating with the mating connector. The shell is formed with a spring portion. The spring portion has a front end which is a fixed end. The spring portion extends rearwards. The spring portion includes a pressed portion and a contact portion. The pressed portion is pressed by the mating connector upon the insertion of the mating connector into the connector. The contact portion is movable in a predetermined direction perpendicular to the front-rear direction. The detection terminal is distinct and separated from the shell. The detection terminal and the spring portion form a detection switch. A state of the detection switch is changed due to the movement of the contact portion in the predetermined direction when the pressed portion is pressed by the mating connector, so that the insertion of the mating connector is detected.

As described above, the detection switch of the connector according to the present invention is formed by the spring portion of the shell and the detection terminal. When the spring portion is pressed and moved by the mating connector upon the mating of the mating connector with the connector so that the state of the detection switch is changed, the insertion of the mating connector can be detected. Thus, it is unnecessary to interpose the mating shell between the shell and the detection terminal. Therefore, irrespective of quality and material of the mating shell of the mating connector, insertion of the mating connector can be detected suitably.

According to the present invention, detection of the insertion is performed only on the basis of whether the spring portion of the shell and the detection terminal are connected or not. On the other hand, in the connector of JPU 3172188, detection of the insertion is performed on the basis of both a connection between the spring portion of the shell and the mating shell and another connection between the detection terminal and the mating shell. Therefore, detection error is more unlikely to occur in the connector of the present invention, in comparison with the connector of JPU 3172188.

Furthermore, the spring portion of the present invention has the front end of the fixed end and extends rearwards. Therefore, the spring portion might not be deformed by the insertion of the mating connector although the spring portion is directly pressed by the mating connector inserted.

An appreciation of the objectives of the present invention and a more complete understanding of its structure may be had by studying the following description of the preferred embodiment and by referring to the accompanying drawings.

Figure 1:
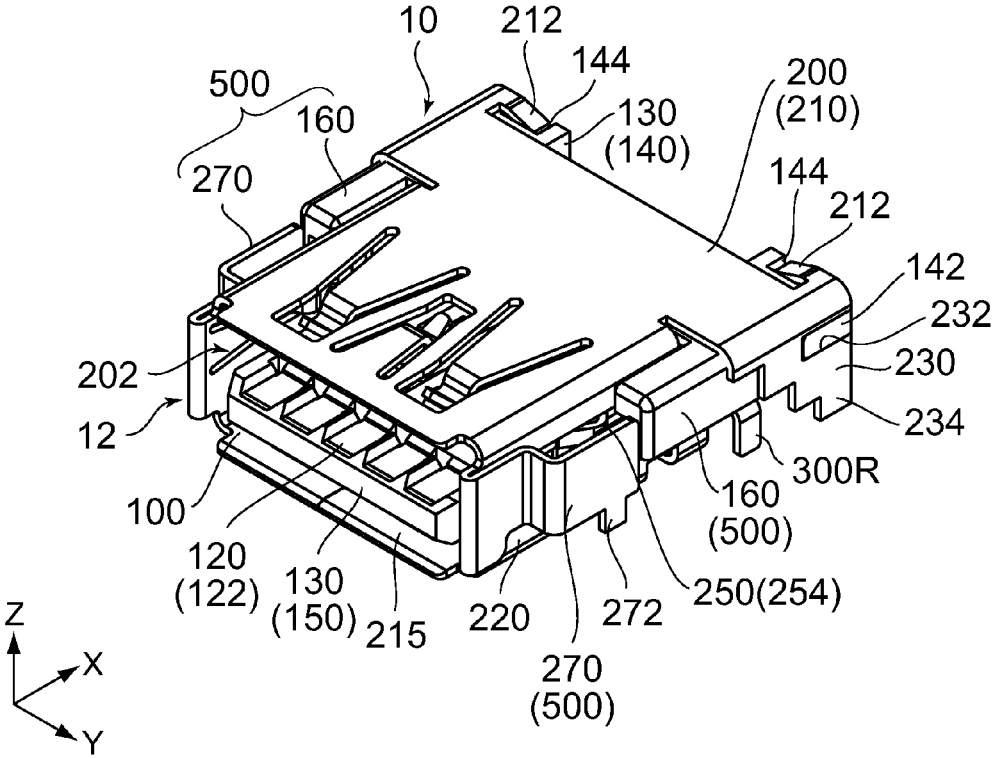
FIG. 1 is a perspective view showing a connector according to an embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

A connector according to an embodiment of the present invention is a USB (Universal Serial Bus) 3.0 receptacle compliant with the USB standard and is matable with a USB 3.0 plug (mating connector: not shown). With reference to FIGS. 1 to 6, the connector 10 according to the present embodiment has a mating end 12 which is positioned at a front side (negative X-side) in a front-rear direction (X-direction). The connector 10 is matable with a mating connector 700 inserted into the connector 10 through the mating end 12 rearwards or along a positive X-direction (See FIGS. 14 to 16). As shown in FIGS. 1, 3, 5 and 6, the connector 10 comprises a structure 100 and a shell 200 made of metal, wherein the structure 100 includes contacts, which are described afterwards, and the shell 200 partially covers the structure 100.

Figure 7:
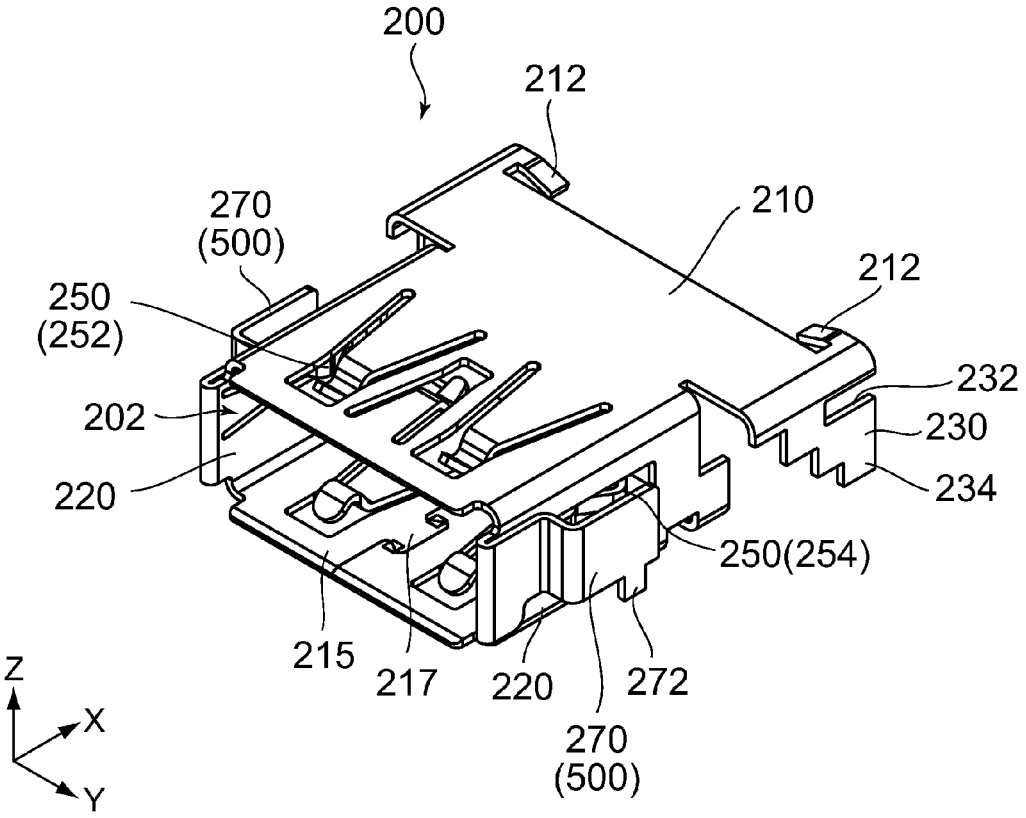
FIG. 7 is a perspective view showing a shell included in the connector of FIG. 1.

As understood from FIGS. 1 and 7, the shell 200 forms a reception portion 202 which receives the mating connector (not shown). In detail, as shown in FIG. 7, the shell 200 is obtained by stamping a single metal plate out, followed by bending the stamped metal plate. The reception portion 202 is constituted by an upper surface (positive Z-side surface) 210, a bottom surface (negative Z-side surface) 215 and side surfaces 220 of the shell 200. The bottom surface 215 of the reception portion 202 is caulked to form caulked portions 217 so that the reception portion 202 has a wide, angular tube-like shape. On the upper surface 210, a relatively larger plane is provided, so that the plane can be picked up by using a vacuum chuck of an automatic component feeder. At a rear end (positive X-side end) of the upper surface 210, swaged portions 212 are formed, wherein the swaged portions 212 are bent inwards in a pitch direction (Y-direction: predetermined direction) and downwards (negative Z-side). Although FIG. 7 shows a state where the swaged portions 212 are already bent, the swaged portions 212 extend in parallel with the pitch direction (Y-direction) in another state before the shell 200 is attached on the structure 100.

Furthermore, the shell 200 is formed with rear-sidewall portions 230 extending downwards or towards the negative Z-side from the vicinities of the rear end of the upper surface 210, respectively. Each of the rear-sidewall portions 230 is formed with an engagement depression 232 and a fixed portion 234, wherein the engagement depression 232 is depressed forwards or along the negative X-direction from a rear edge of the engagement depression 232, and the fixed portion 234 is inserted and fixed into a through-hole (not shown) of a circuit board (not shown) upon the connector 10 is mounted on the circuit board (not shown).

Figure 5:
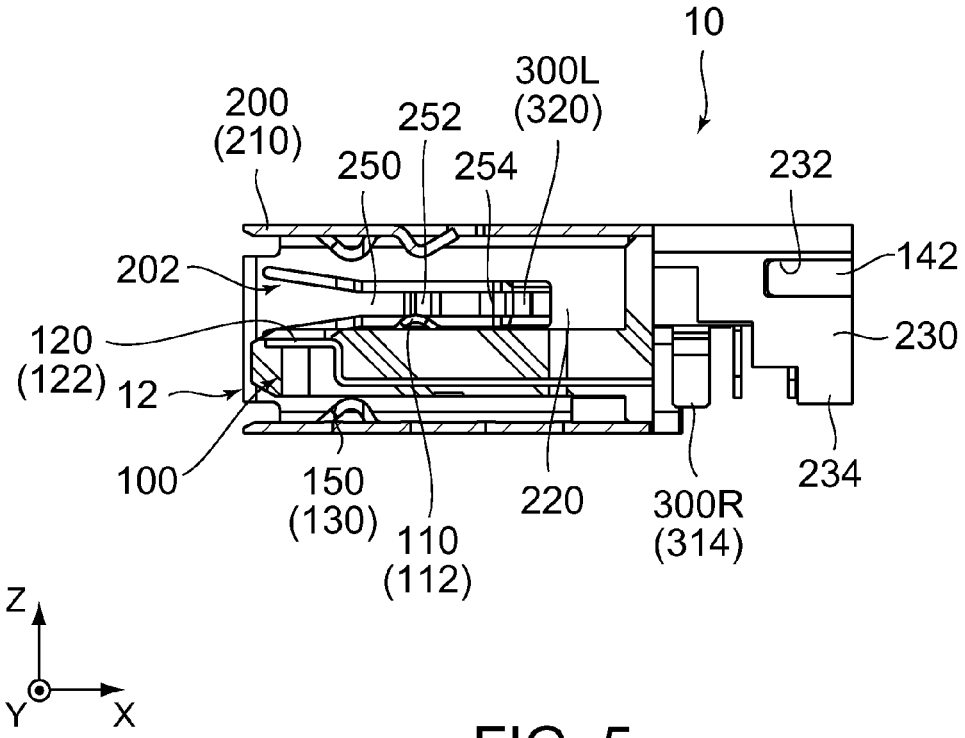
FIG. 5 is a partially cut-away view showing the connector of FIG. 2, taken along line V-V.
Figure 6:
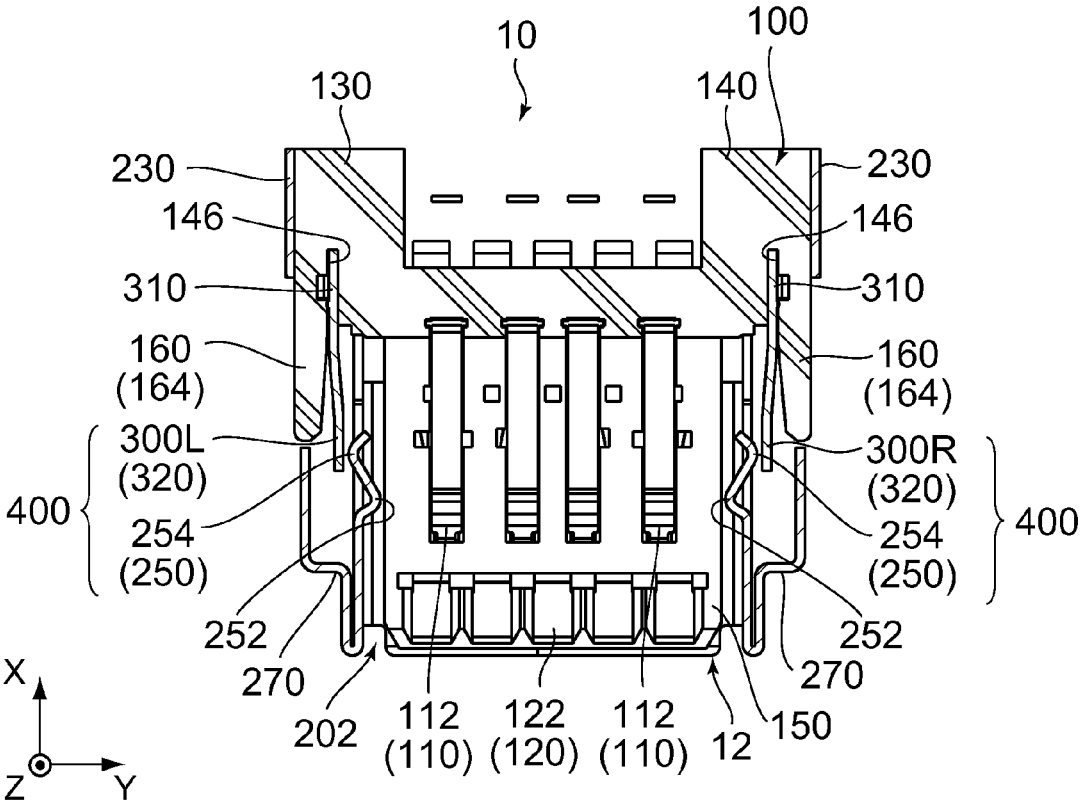
FIG. 6 is a cross-sectional view showing the connector of FIG. 3, taken along line VI-VI.

As shown in FIGS. 5 to 7, each of the side surfaces 220 is formed with a spring portion 250. The spring portion 250 has a front end (negative X-side end), which is a fixed end, and extends rearwards or along positive X-direction. The illustrated spring portion 250 has a pressed portion 252 and a contact portion 254, wherein the pressed portion 252 protrudes inwards in the pitch direction (Y-direction) to form a dogleg portion, and the contact portion 254 protrudes outwards in the pitch direction (Y-direction) to form another dogleg portion. As best shown in FIG. 6, the pressed portion 252 is positioned forwards or towards the negative X-side in comparison with the contact portion 254. In other words, in the connector 10 according to the present embodiment, a distance between the mating end 12 and the pressed portion 252 is shorter than another distance between the mating end 12 and the contact portion 254.

Figure 14:
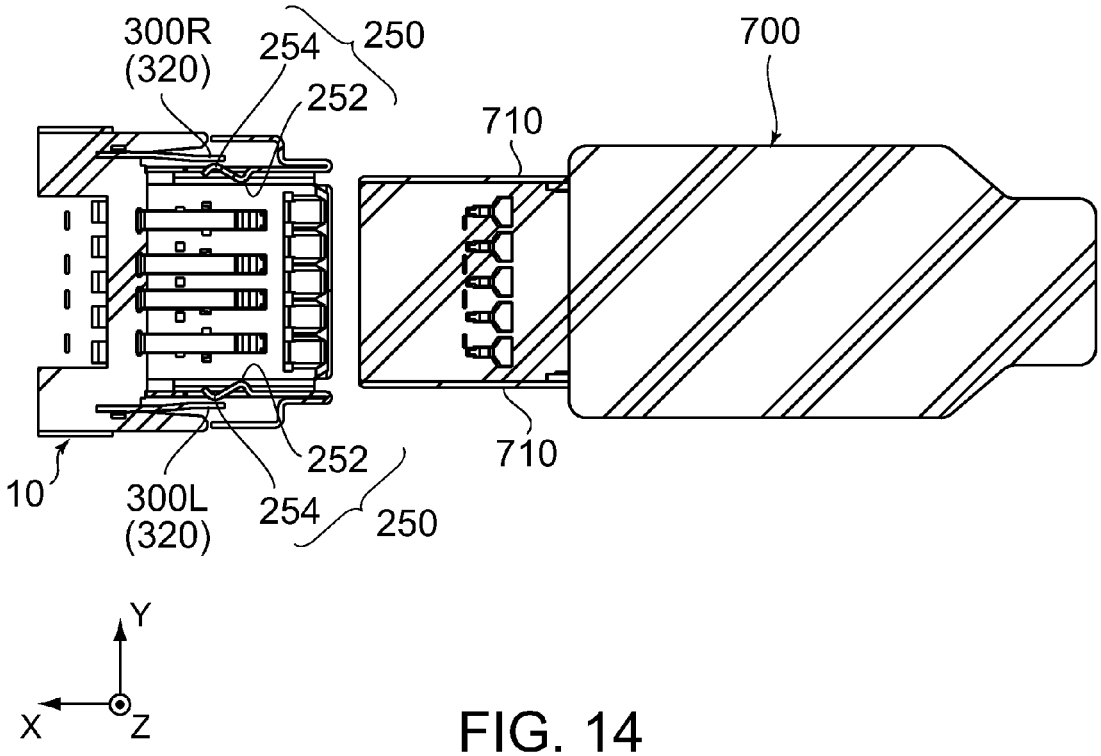
FIG. 14 is a cross-sectional view showing the connector of FIG. 6 and a mating connector. The connector and the mating connector are not mated yet. The mating connector is schematically shown.
Figure 15:
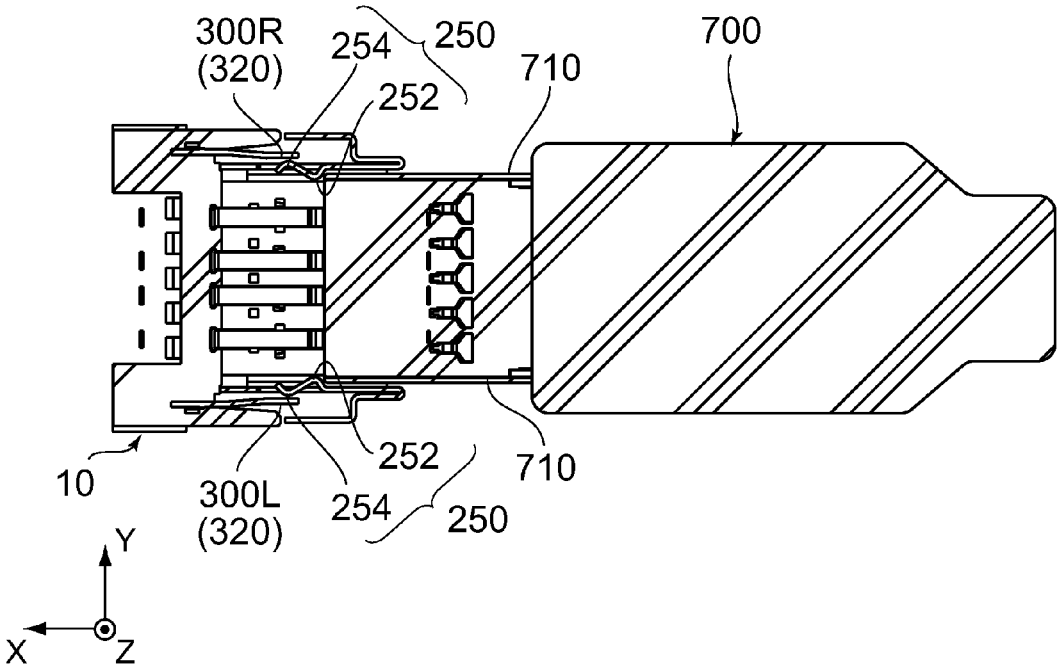
FIG. 15 is a cross-sectional view showing the connector and the mating connector of FIG. 14. The connector and the mating connector are in the progress of mating.
Figure 16:
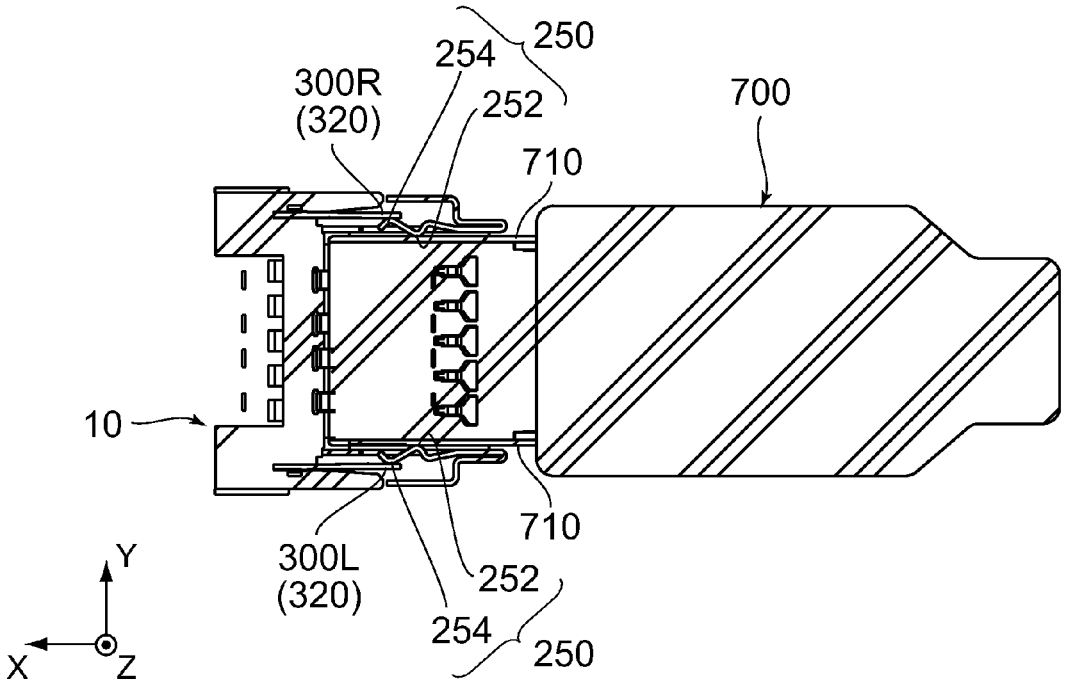
FIG. 16 is a cross-sectional view showing the connector and the mating connector of FIG. 14. The connector and the mating connector are fit with each other.

The spring portions 250 according to the present embodiment are springs for measures against EMI (Electromagnetic Interference) and, with reference to FIGS. 14 to 16, are used to be connected to a mating shell 710 upon the mating of the connector 10 with the mating connector 700 so as to improve a shielding effect. In other words, in the present embodiment, the springs for measures against EMI are used as the spring portions 250, respectively. However, the present invention is not limited thereto. For example, if the mating connector does not have the mating shell made of conductor but have a mating shell made of non-conductor, the connector 10 does not have the springs for measures against EMI. Even in such case, the spring portions 250 are formed as parts of the shell 200 so that each of the spring portions 250 meets the condition where the spring portion 250 has the front end of the fixed end and extends rearwards.

Figure 3:
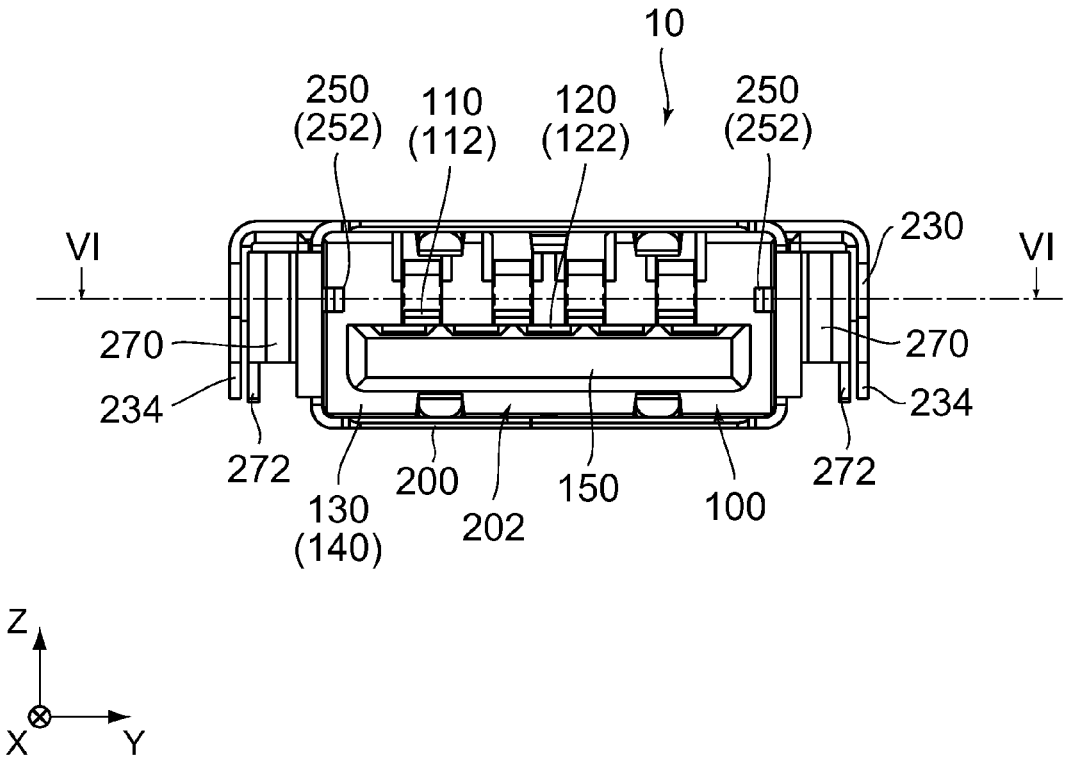
FIG. 3 is a front view showing the connector of FIG. 1.
Figure 4:
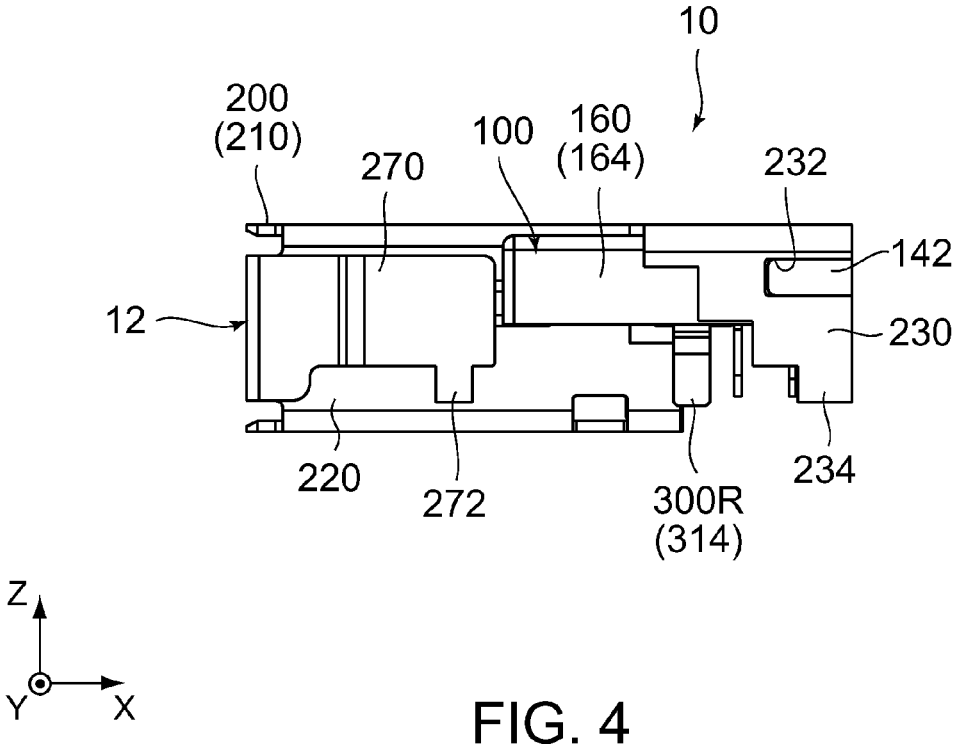
FIG. 4 is a side view showing the connector of FIG. 1.

As understood from FIGS. 3 and 5, each of the pressed portions 252 of the present embodiment projects within the reception portion 202. As shown in FIGS. 14 to 16, the pressed portion 252 is pressed by the mating shell 710 when the connector 10 is mated with the mating connector 700. Because of the pressing, the contact portion 254 corresponding to the pressed portion 252 moves outwards in the pitch direction. Since each of the spring portions 250 of the present embodiment has the front end of the fixed end and extends rearwards as described above, there is no possibility in the present embodiment that the spring portion 250 buckles due to insertion of the mating connector 700.

As best shown in FIG. 6, each of the side surfaces 220 of the shell 200 is provided with a folded-back portion 270, which is folded to extend rearwards or along the positive X-direction from the mating end 12 of the connector 10 or a front end of the shell 200. As shown in FIG. 7, the folded-back portion 270 is formed with a fixed portion 272, which is inserted and fixed into a through-hole (not shown) of a circuit board (not shown) upon the connector 10 is mounted on the circuit board (not shown).

As shown in FIGS. 8 to 12, the structure 100 according to the present embodiment comprises USB2.0 contacts (contacts) 110 and USB3.0 contacts (contacts) 120 both made of conductor, a holder 130 made of insulator and detection terminals 300R, 300L made of conductor.

The USB2.0 contacts 110 are contacts for signal transmission compliant with the USB2.0 standard. The number of the USB2.0 contacts 110 is four. Each USB2.0 contact 110 has a contact portion 112. The USB3.0 contacts 120 are contacts for signal transmission compliant with the USB3.0 standard. The number of the USB3.0 contacts 120 is five. Each USB3.0 contact 120 has a contact portion 122. The USB2.0 contacts 110 are press-fit into the holder 130 and are held thereby. USB3.0 contacts are partially embedded into the holder 130 through the insert-molding method. The USB2.0 contacts 110 are arranged in the pitch direction (Y-direction). Likewise, the USB3.0 contacts 120 are arranged in the pitch direction (Y-direction). In detail, as shown in FIGS. 3 and 6, the contact portions 112 of the USB2.0 contacts 110 are arranged in a line in the pitch direction, while the contact portions 122 of the USB3.0 contacts 120 are arranged in a line in the pitch direction.

The holder 130 has a block portion 140, a plate-like portion 150 and wall portions 160, wherein the plate-like portion 150 projects forwards or along the negative X-direction from the block portion 140, and the wall portions 160 extend forwards or along the negative X-direction from opposite ends of the block portion 140 in the pitch direction (Y-direction). The contact portions 112 of the USB2.0 contacts 110 and the contact portions 122 of the USB3.0 contacts 120, both held by the holder 130, are exposed on the upper surface 152 of the plate-like portion 150 and are contactable.

Figure 8:
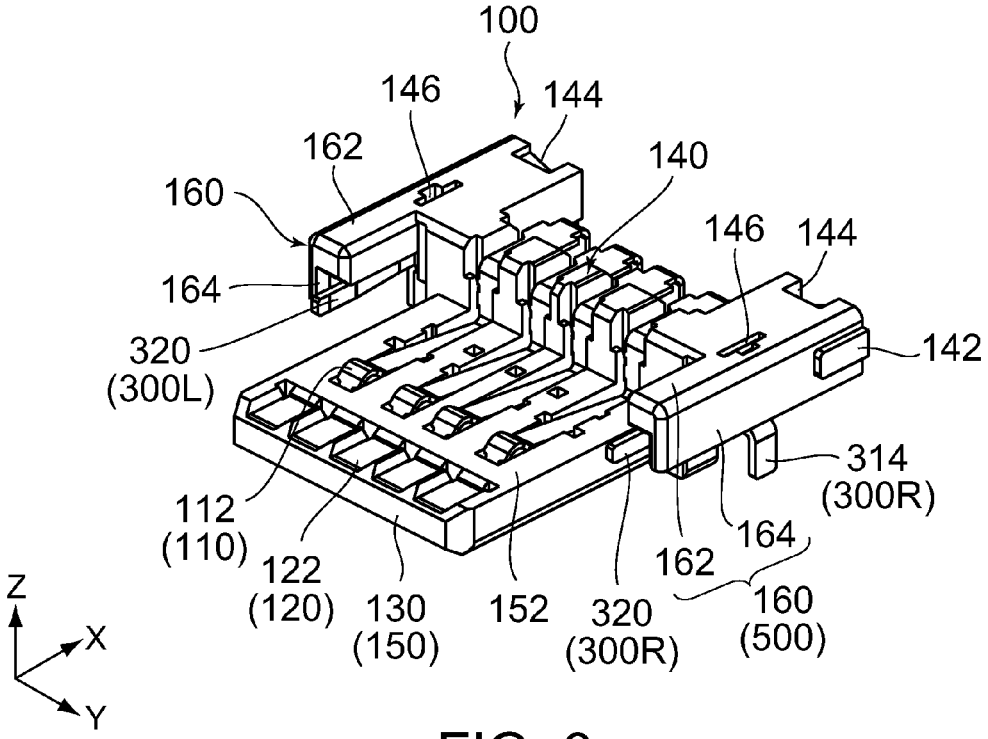
FIG. 8 is a perspective view showing a structure other than the shell, which is included in the connector of FIG. 1.
Figure 9:
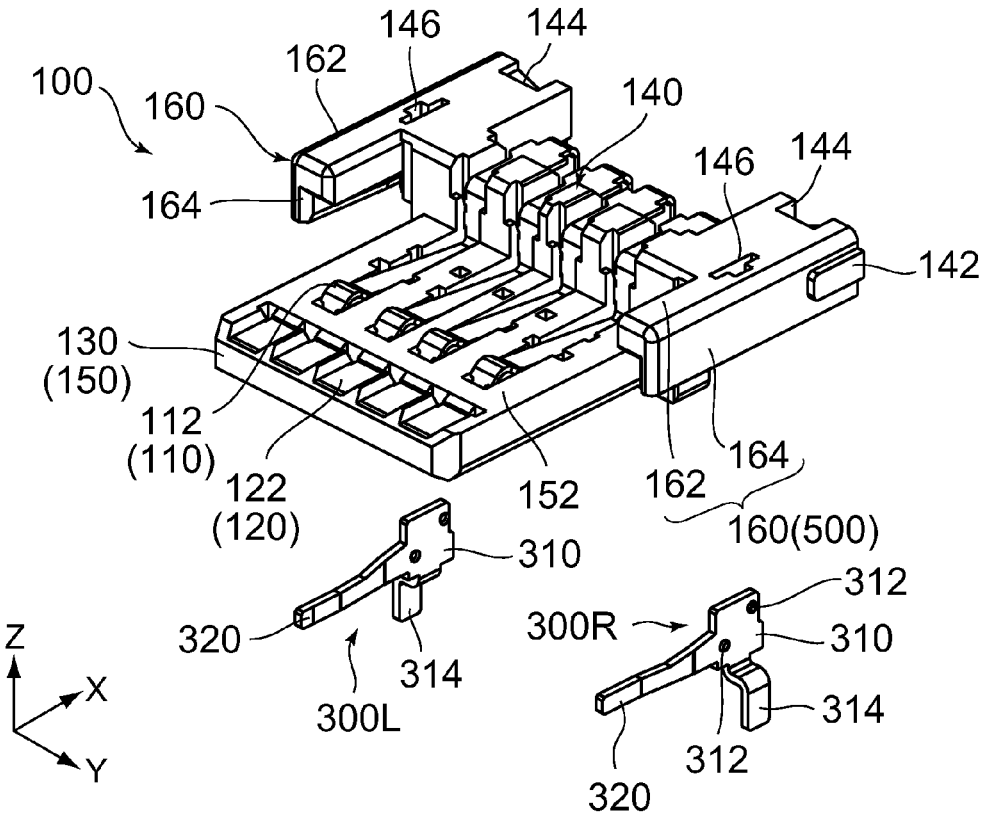
FIG. 9 is a perspective view showing the structure of FIG. 8. Detection terminals are not fit in a holder.
Figure 10:
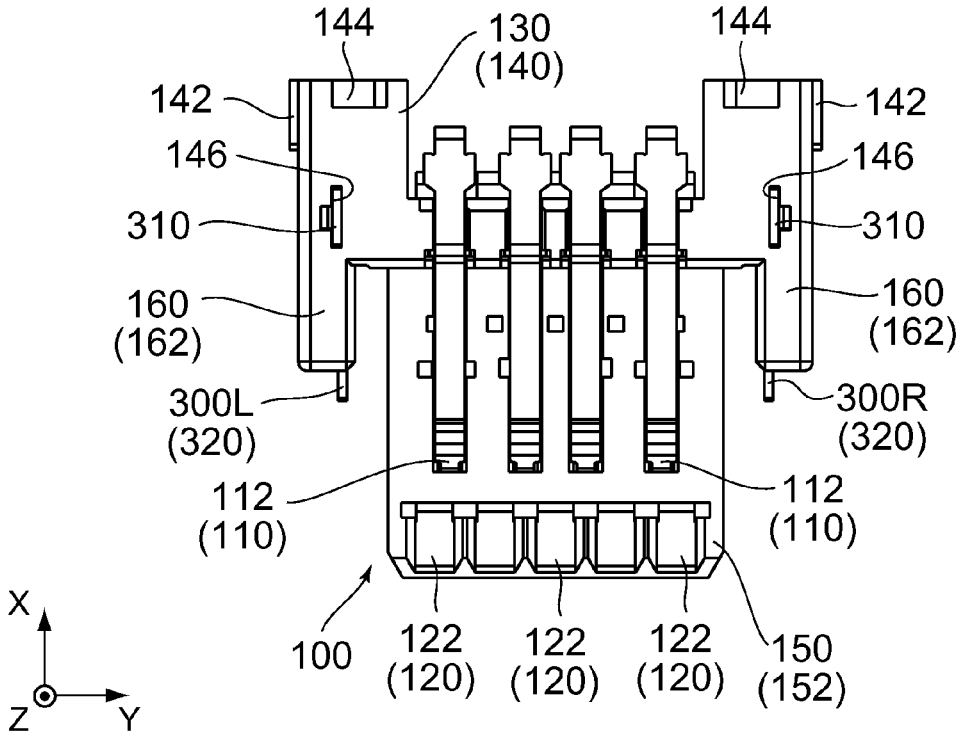
FIG. 10 is a top plan view showing the structure of FIG. 8.
Figure 11:
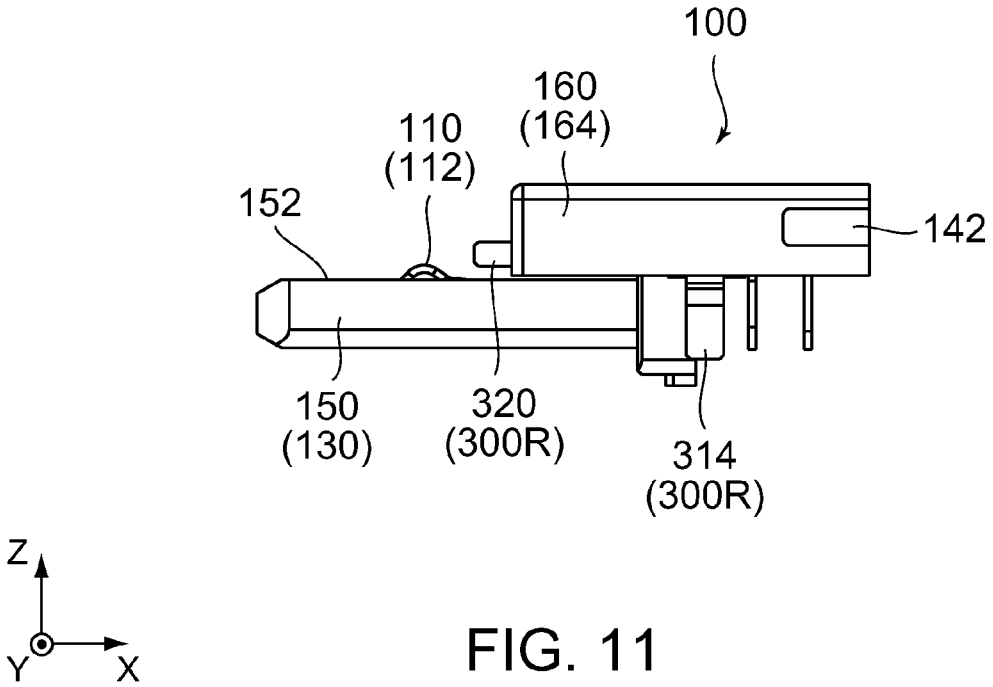
FIG. 11 is a side view showing the structure of FIG. 8.

As shown in FIGS. 8 to 10, in upper rear end portions (end portions of positive Z-side and positive X-side) of the block portion 140, depressions 144 are formed to be depressed downwards or along the negative Z-direction. Around the rear end (positive X-side end) of each wall portion 160, an engagement protrusion 142 is formed to protrude outwards in the pitch direction. As understood from FIGS. 1 and 2, the structure 100 is inserted forwards or along the negative X-direction through the rear end (positive X-side end) of the shell 200, and the swaged portions 212 of the shell 200 are bent in the depression 144 so that the shell 200 is attached to the structure 100. Upon the attachment, the engagement protrusions 142 of the holder 130 are engaged with the engagement depressions 232, respectively. The engagements regulate vertical movement (or movement in the Z-direction) of the shell 200 to the holder 130.

As shown in FIGS. 8 to 10, around the boundaries between the block portion 140 and the wall portions 160, slits 146 are formed, respectively, to piercing the holder 130 in the vertical direction. The slits 146 are portions in which the detection terminals 300R, 300L are press-fit, respectively. Provided that the detection terminals 300R, 300L are press-fit in the slits 146, respectively, the slits 146 may not pierce the holder 130.

Figure 12:
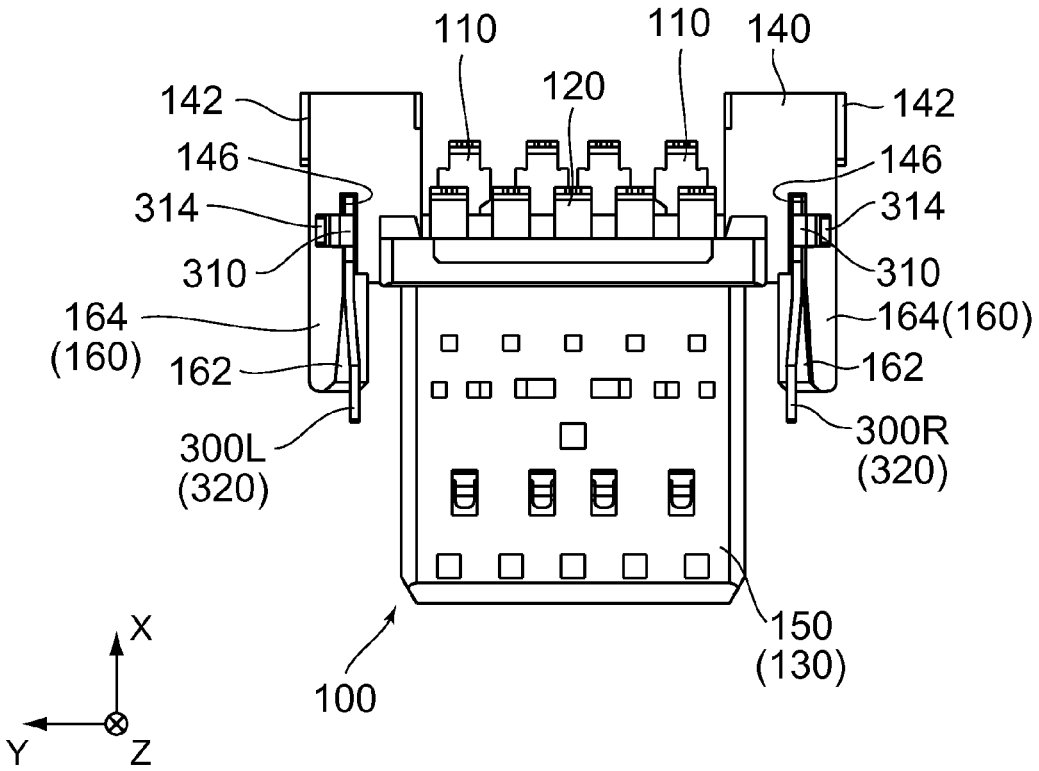
FIG. 12 is a bottom view showing the structure of FIG. 8.

As shown in FIGS. 8, 9 and 12, each of the wall portions 160 has an upper wall portion 162 and a sidewall portion 164. As understood from FIGS. 8, 9 and 12, each wall portion 160 has an L-like shape in a plane perpendicular to the front-rear direction (X-direction) and is provided to protect the detection terminal 300R, 300L, as described in detail afterwards. Especially, as shown in FIG. 12, each sidewall portion 164 of the present embodiment has a shape which tapers forwards or towards the negative X-side. An inner wall surface of the sidewall portion 164 extends forwards (negative X-direction) and outwards in the pitch direction (Y-direction).

As understood from FIGS. 1, 8 and 9, the detection terminals 300R, 300L according to the present embodiment are distinct and separated from the shell 200. As understood from FIGS. 8 and 9, the detection terminals 300R, 300L according to the present embodiment are press-fit into the slits 146 of the holder 130, respectively, from the lower side (negative Z-side) thereof. As shown in FIG. 9, the detection terminals 300R, 300L have shapes symmetric with each other.

Figure 13:
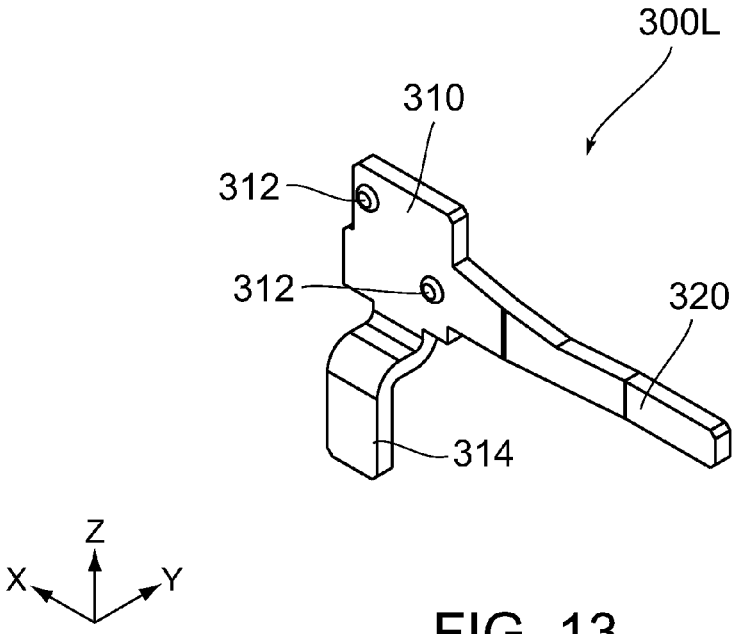
FIG. 13 is a perspective view showing one of the detection terminals of FIG. 9.

Here, explanation is directed to the detection terminal 300L shown in FIG. 13, and explanation about the detection terminal 300R is omitted because they have similar shape to each other. The detection terminal 300L has a fit portion 310, a fixed portion 314 and a detection spring portion 320, wherein the fit portion 310 has a plate-like shape and is press-fit into the slit 146, the fixed portion 314 extends downwards or towards the negative Z-side of the fit portion 310, and the detection spring portion 320 extends forwards or towards the negative X-side of the fit portion 310. The fit portion 310 is formed with a dowel 312. When the fit portion 310 is press-fit into the slit 146, the dowel 312 presses the fit portion 310 against an inner surface of the slit 146. As shown in FIGS. 12 and 13, the detection spring portion 320 is slightly bent inwards in the pitch direction (Y-direction). Therefore, as shown in FIG. 12, when the fit portion 310 is press-fit into the slit 146, a sufficient space for deformation of the detection spring portion 320 can be ensured between an inner surface of the sidewall portion 164 of the wall portion 160 and the detection spring portion 320. The fixed portion 314 is inserted and fixed into a through-hole (not shown) of a circuit board (not shown) when the connector 10 is mounted on the circuit board (not shown).

The detection terminals 300R, 300L together with the respective spring portions 250 form detection switches 400. In detail, with reference to FIGS. 6, 14 to 16, each of the detection switches 400 changes its switch state by the movement of the contact portion 254 in the pitch direction (predetermined direction: Y-direction) when the pressed portion 252 of the spring portion 250 is pressed by the mating connector 700. In this embodiment, insertion of the mating connector 700 can be detected on the basis of the state change of the detection switch 400.

More specifically, as shown in FIG. 6, the detection switch 400 according to the present embodiment normally opens. Namely, the detection switch 400 turns off in an unloaded condition where the connector 10 and the mating connector 700 are, for example, unmated with each other. In detail, as shown in FIG. 6, when the connector 10 and the mating connector 700 are unmated with each other, the spring portions 250 and the detection terminals 300R, 300L are arranged so that the contact portions 254 of the spring portions 250 are not in contact with the detection terminals 300R, 300L. On the other hand, as understood from FIGS. 14 to 16, when the pressed portions 252 are pressed by the insertion of the mating connector 700 to move the contact portions 254 in the pitch direction (predetermined direction: Y-direction), the spring portions 250 and the detection terminals 300R, 300L are arranged so that the contact portions 254 are brought into contact with the detection spring portions 320 of the detection terminals 300R, 300L.

Figure 2:
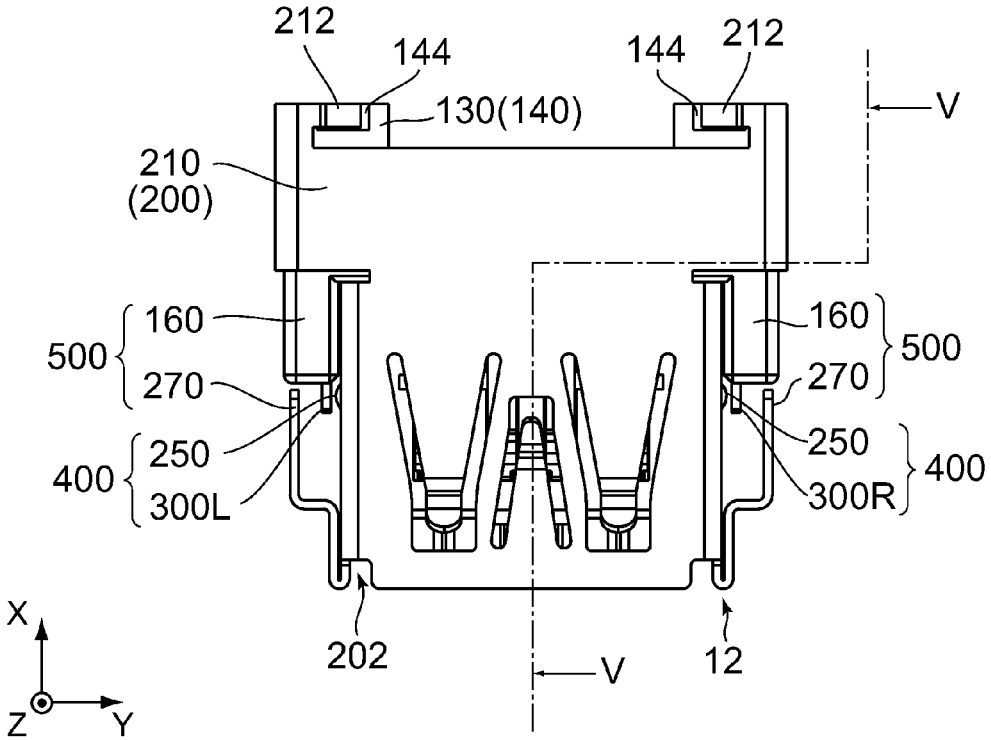
FIG. 2 is a top plan view showing the connector of FIG. 1.
Figure 17:
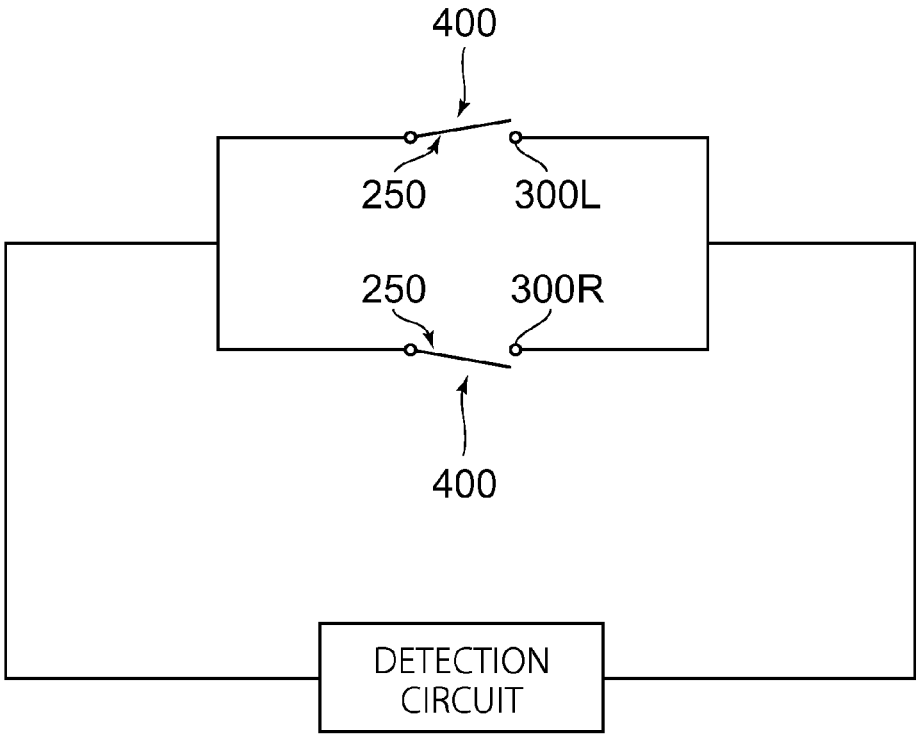
FIG. 17 is a diagram schematically showing a detection system which includes the connector of FIG. 1.

As shown in FIGS. 2 and 6, the number of the detection switches 400 is two in this embodiment. Namely, the number of sets of the spring portions 250 and the detection terminals 300R, 300L is two. In a detection system as shown in FIG. 17, the detection switches 400 are arranged parallel to each other and are connected to a detection circuit provided outside of the connector 10. Thus, according to the present embodiment, when at least one of two detection switches 400 changes its state, the insertion of the mating connector 700 can be detected.

Figure 18:
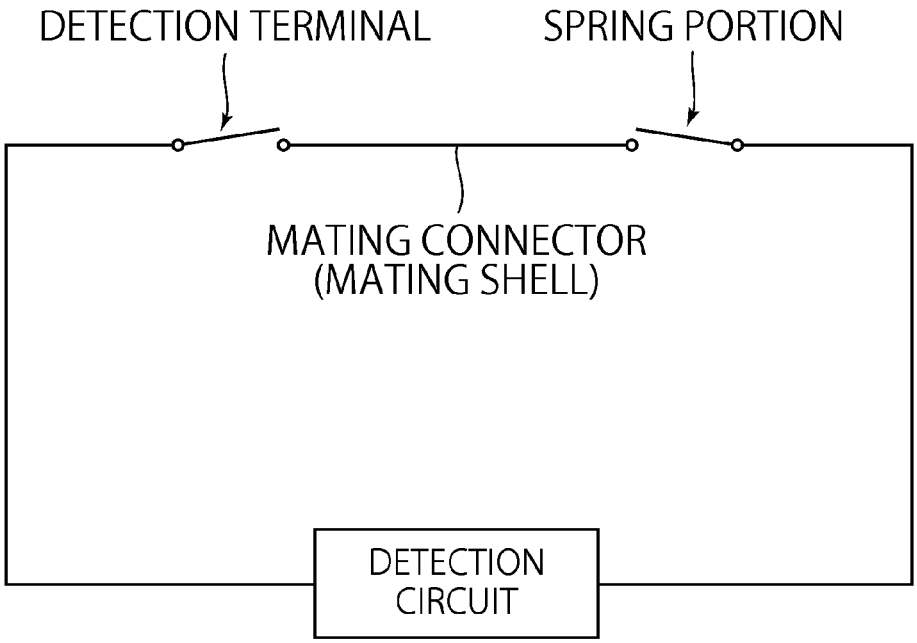
FIG. 18 is a diagram schematically showing a detection system which is formed by using a connector of JPU 3172188.
Figure 19:
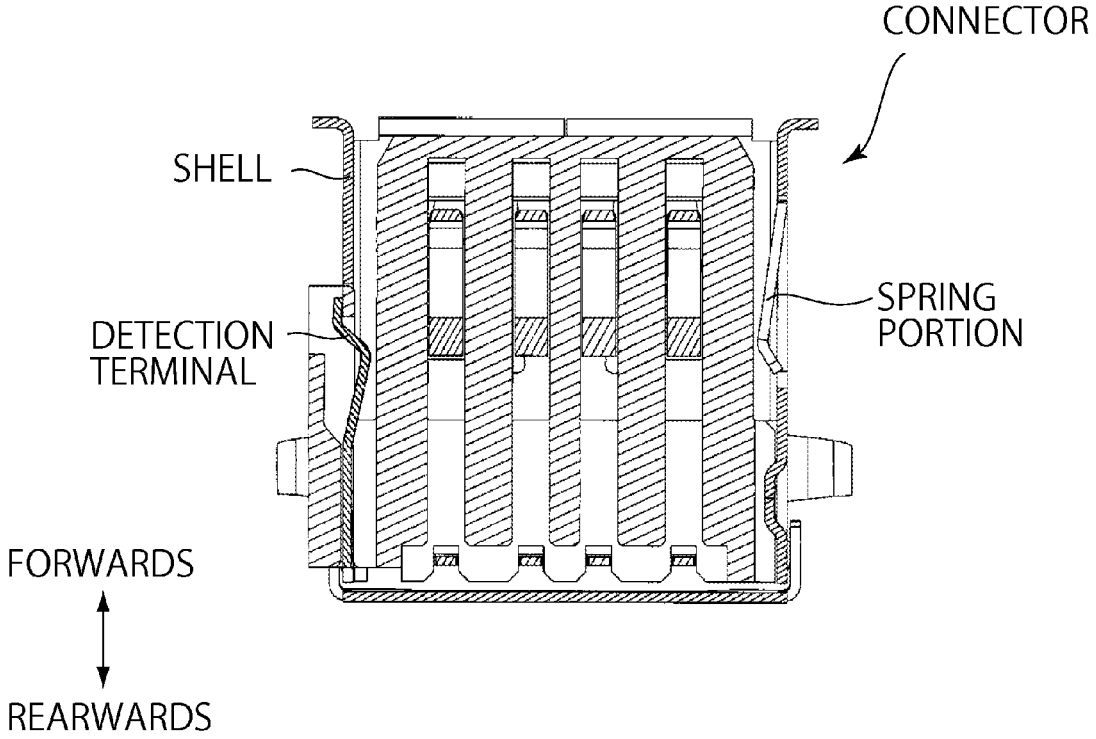
FIG. 19 is a cross-sectional view showing a connector of JPU 3172188.

For example, as shown in FIG. 18, a detection system using the connector of JPU 3172188 must include the mating shell in a signal loop forming the detection system. Thus, the detection system using the connector of JPU 3172188 has a problem that detection accuracy depends on quality, materials, and so on, of the mating shell. In addition, since the detection system based on JPU 3172188 utilizes conductivity of the mating shell, it cannot detect insertion of a mating connector with a mating shell made of non-conductor.

On the contrary, as shown in FIG. 17, the detection switches 400 are constituted by the spring portions 250 of the shell 200 and the detection terminals 300R, 300L, respectively. A detection system using the connector 10 of the present embodiment does not include the mating shell 710 of the mating connector 700 in a signal loop forming the detection system. Thus, because it is unnecessary for the mating shell 710 to be interposed between the shell 200 and the detection terminals 300R, 300L, the detection system based on the present embodiment can properly detect insertion of the mating connector 700 irrespective of quality, materials, and so on, of the mating shell 710. In addition, even if the mating connector 700 includes a mating shell made of non-conductor, the detection system based on the present embodiment can detect insertion of the mating connector 700.

Furthermore, as understood from FIG. 18, the detection system based on JPU 3172188 cannot detect insertion of the mating connector unless both of a connection between the spring portion of the shell and the mating shell and another connection between the detection terminal and the mating shell are established.

On the other hand, as shown in FIG. 17, the detection system based on the present embodiment can detect insertion of the mating connector 700 even if any one of the detection switches 400 of the spring portions 250 of the shell 200 and the detection terminals 300R, 300L changes its switch state.

With reference to FIG. 2, the wall portions 160 of the aforementioned holder 130 and the folded-back portions 270 of the aforementioned shell 200 serve as protection portions 500 which protect the respective detection switches 400 from a worker or user of the connector 10. For example, if the detection terminals 300R, 300L are exposed, the worker of the connector 10 might touch the detection terminals 300R, 300L to deform or bent the detection spring portions 320. However, the connector 10 of the present embodiment can avoid the problem of the deformation of the detection terminals 300R, 300L as the upper wall portions 162 of the wall portions 160 are positioned above or on the positive Z-side of the detection terminals 300R, 300L while the sidewall portions 164 are positioned outwards of the detection terminals 300R, 300L in the pitch direction (Y-direction), as shown in FIG. 12, and the folded-back portions 270 are positioned diagonally in front of the detection terminals 300R, 300L or positioned outwards of the detection terminals 300R, 300L in the Y-direction and towards the negative X-side, as shown in FIGS. 2 and 6.

Although the present invention was explained in detail through the description of the preferred embodiment, the present invention is not limited thereto but may be modified in various manners.

For example, although the spring portions 250 are formed in the side surfaces 220 of the shell 200 in the above-mentioned embodiment, the spring portions 250 may be formed in the upper surface 210 or the bottom surface 215. In this connection, the predetermined direction may be the vertical direction (Z-direction) instead of the pitch direction.

In the above-described embodiment, the pressed portions 252 protrude inwards in the predetermined direction (pitch direction: Y-direction) while the contact portions 254 protrudes outwards in the predetermined direction so that the contact portions 254 move outwards in the predetermined direction when the pressed portions 252 are pressed by the mating connector 700. However, the present invention is not limited thereto. For example, the pressed portions 252 may protrude outwards in the predetermined direction while the contact portions 254 may protrudes inwards in the predetermined direction so that the contact portions 254 move inwards in the predetermined direction when the pressed portions 252 are pressed by the mating connector 700.

Although the contact portions 254 according to the present embodiment form the dogleg portions, the contact portions 254 may be simple terminals which are not bent to form dogleg shapes.

Although the distance between the mating end 12 and the pressed portion 252 is shorter than the other distance between the mating end 12 and the contact portion 254 in the aforementioned embodiment, the distance between the mating end 12 and the pressed portion 252 may be longer than the other distance between the mating end 12 and the contact portion 254. In other words, the contact portion 254 may be positioned forwards or towards the negative X-side in comparison with a corresponding one of the pressed portions 252.

Although the detection terminals 300R, 300L are press-fit into the slits 146 of the holder 130 in the aforementioned embodiment, the present invention is not limited thereto. For example, the detection terminals 300R, 300L may be partially embedded in and held by the holder 130 through the insert-molding process.

Although the detection switches 400 according to the aforementioned embodiment normally open, i.e., turn off in the unloaded condition the where the connector 10 and the mating connector 700 are for example unmated with each other, the present invention is not limited thereto. The detection switches 400 may normally close. Namely, the detection switches 400 may turn on in the unloaded condition.

The present application is based on a Japanese patent application of JP2012-284563 filed before the Japan Patent Office on Dec. 27, 2012, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector comprises:

a mating end which is positioned at a front of the connector in a front-rear direction, the connector mating with a mating connector when the mating connector is inserted through the mating end rearwards;

a plurality of contacts;

a holder holding the contacts;

a shell forming a reception portion which receives, at least in part, the mating connector under a mating state where the connector mating with the mating connector, the shell being formed with a spring portion, the spring portion having a front end which is a fixed end, the spring portion extending rearwards, the spring portion including a pressed portion and a contact portion, the pressed portion being pressed by the mating connector upon the insertion of the mating connector into the connector, the contact portion being movable in a predetermined direction perpendicular to the front-rear direction; and a detection terminal distinct and separated from the shell, the detection terminal and the spring portion forming a detection switch, a state of the detection switch being changed due to the movement of the contact portion in the predetermined direction when the pressed portion is pressed by the mating connector, so that the insertion of the mating connector is detected.

2. The connector as recited in claim 1, wherein:

before the mating connector is inserted into the connector, the contact portion is not in contact with the detection terminal; and when the pressed portion is pressed by the mating connector, the contact portion moves in the predetermined direction to be in contact with the detection terminal.

3. The connector as recited in claim 1, wherein:

the contacts are arranged in a pitch direction perpendicular to the front-rear direction; and the predetermined direction is the pitch direction.

4. The connector as recited in claim 1, wherein the contact portion moves outwards in the predetermined direction when the pressed portion is pressed by the mating connector.

5. The connector as recited in claim 1, wherein, in the front-rear direction, a distance between the mating end and the pressed portion is shorter than another distance between the mating end and the contact portion.

6. The connector as recited in claim 1, wherein the spring portion has a dogleg rear end which is bent at the contact portion.

7. The connector as recited in claim 1, wherein the detection terminal is press-fit into the holder.

8. The connector as recited in claim 1, wherein the detection terminal is partially embedded in the holder via insert-molding.

9. The connector as recited in claim 1, wherein:

the connector includes two sets of the detection terminals and the spring portions;

based on state change of at least one of the detection switch formed of one set of the detection terminal and the spring portion and the detection switch formed of a remaining one set of the detection terminal and the spring portion, the insertion of the mating connector is detected.

10. The connector as recited in claim 1, further comprising a protection portion which protects the detection terminal so that, when a worker handles the connector, the worker is prevented from touching the detection terminal.

11. The connector as recited in claim 10, wherein:

the shell has a folded-back portion which is folded to extend rearwards from a front end of the shell, the folded-back portion being positioned diagonally in front of the detection terminal to protect the detection terminal;

the holder has a wall portion which is positioned outside of the detection terminal in the predetermined direction and which protects, at least in part, the detection terminal; and the folded-back portion and the wall portion form the protection portion.

* * * * *